US005816556A

United States Patent [19]

Liao

[11] Patent Number: 5,816,556

[45] Date of Patent: Oct. 6, 1998

[54] ADJUSTABLE CHAIR STAND

[75] Inventor: Tsun-Chi Liao, Taichung, Taiwan

[73] Assignee: HWA Shin Musical Instrument Co., Ltd., Taichung, Taiwan

[21] Appl. No.: 963,613

[22] Filed: Nov. 4, 1997

[51] Int. Cl.[6] ..... A47C 3/24

[52] U.S. Cl. ..... 248/405; 297/344.18

[58] Field of Search ..... 297/344.18, 344.12; 248/405, 406

[56] References Cited

U.S. PATENT DOCUMENTS 3,086,744 4/1963 Cramer, Jr. ..... 248/406.1
3,870,271 3/1975 Bowman ..... 297/344.12 X
4,253,632 3/1981 Doerner ..... 248/405
5,722,627 3/1998 Hoshino ..... 297/344.18 X

*Primary Examiner*—Peter R. Brown
*Attorney, Agent, or Firm*—Bacon & Thomas

[57] ABSTRACT

An adjustable chair stand including a stand having a socket at a top side thereof, a threaded stem inserted into the socket and secured thereto to support a seat at the desired elevation, a bushing mounted in the socket around the threaded stem and having an arched packing plate in a side opening thereof, a lock screw mounted on the socket and turned to press on the arched packing plate against the threaded stem, and a clamping device fastened to the threaded stem and supported on the socket to stop the threaded stem from linear movement, the clamping device including two hinged arched clamping plates, and a fastener adapted to fix the free ends of the hinged arched clamping plates together.

1 Claim, 7 Drawing Sheets

ADJUSTABLE CHAIR STAND

BACKGROUND OF THE INVENTION

The present invention relates to chairs, and more specifically to an adjustable chair stand for chairs which allows the seat supporting stem to be directly moved up and down to the desired elevation without through a rotary motion when unlocked.

FIGS. 1 and 2 show a regular chair for sitting when playing a musical instrument. The chair comprises an adjustable chair stand and a seat mounted on the adjustable chair stand. The adjustable chair stand comprises a stand, a tubular center shaft mounted on the stand, a connector fixedly connected to the tubular center shaft at the top, the connector defining an inner thread, a threaded stem threaded into the inner thread of the connector, a cap nut threaded onto the threaded stem and covered on the connector, and a tightening up screw threaded into a screw hole on the cap nut and stopped against the connector. Because the threaded stem is threaded into the inner thread of the connector, the threaded stem must be turned upwards or downwards to adjust the elevation of the seat when the tightening up screw is loosened. Because the threaded stem cannot be directly lifted or lowered to the desired elevation, the elevation adjustment procedure takes much time.

SUMMARY OF THE INVENTION

The present invention has been accomplished to provide an adjustable chair stand which eliminates the aforesaid problem. It is therefore the main object of the present invention to provide an adjustable chair stand allows the user to directly move the seat up and down to the desired elevation without a rotary motion. To achieve this and other objects of the present invention, there is provided an adjustable chair stand which comprises a socket at the top, a threaded stem inserted into the socket and secured thereto to support a seat at the desired elevation, a bushing mounted in the socket around the threaded stem and having an arched packing plate in a side opening thereof, a lock screw mounted on the socket and turned to press on the arched packing plate against the threaded stem in securing the threaded stem in place, and a clamping device fastened to the threaded stem and supported on the socket to stop the threaded stem from linear movement, the clamping device comprising two hinged arched clamping plates, and a fastener adapted to fix the free ends of the hinged arched clamping plates together.

DETAILED DESCRIPTION OF THE PREFERRED EMBODIMENT

Figure 1:
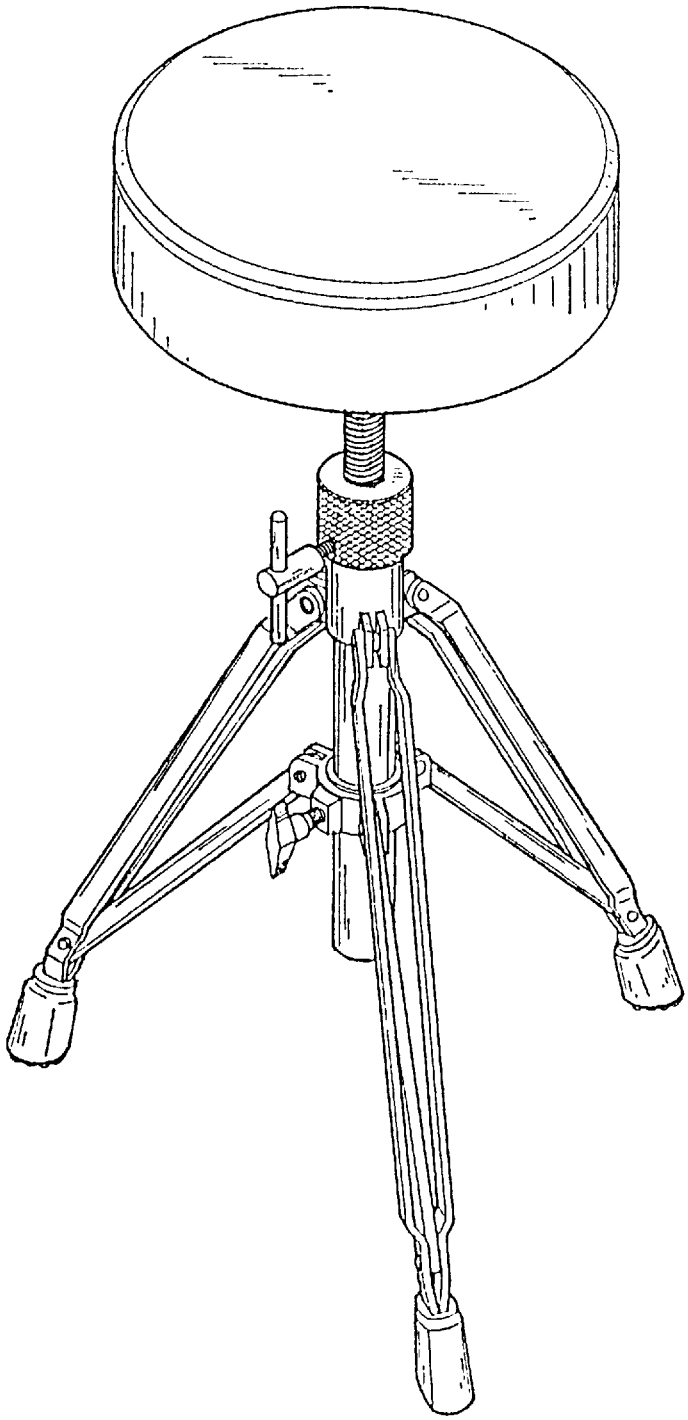
Fig.1 PRIOR ART
FIG. 1 an elevational view of a regular chair.
Figure 2:
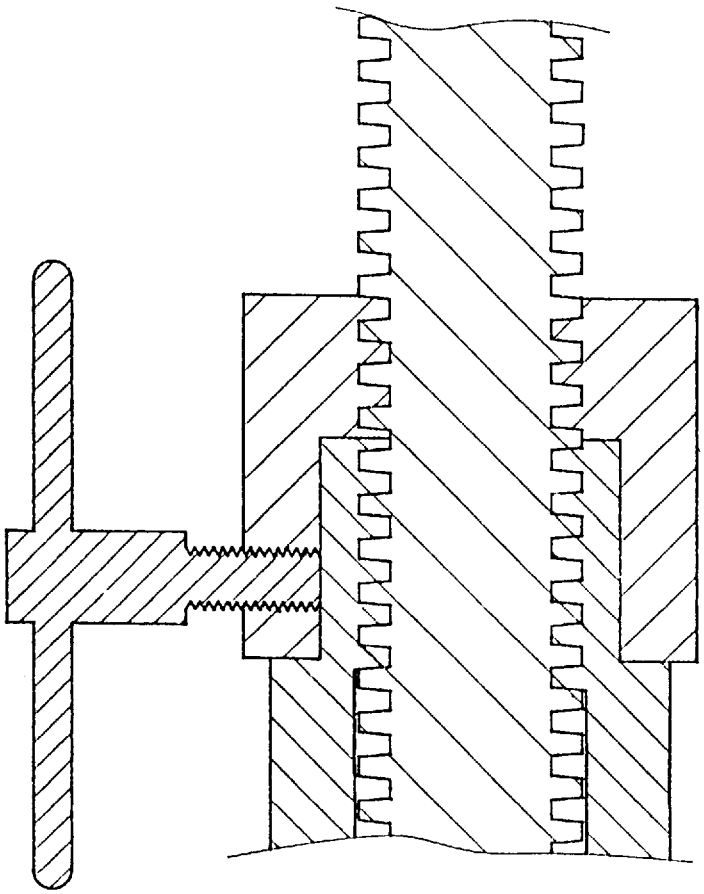
Fig.2 PRIOR ART
FIG. 2 is a sectional in an enlarged scale of a part of the adjustable chair stand of the chair shown in FIG. 1.
Figure 3:
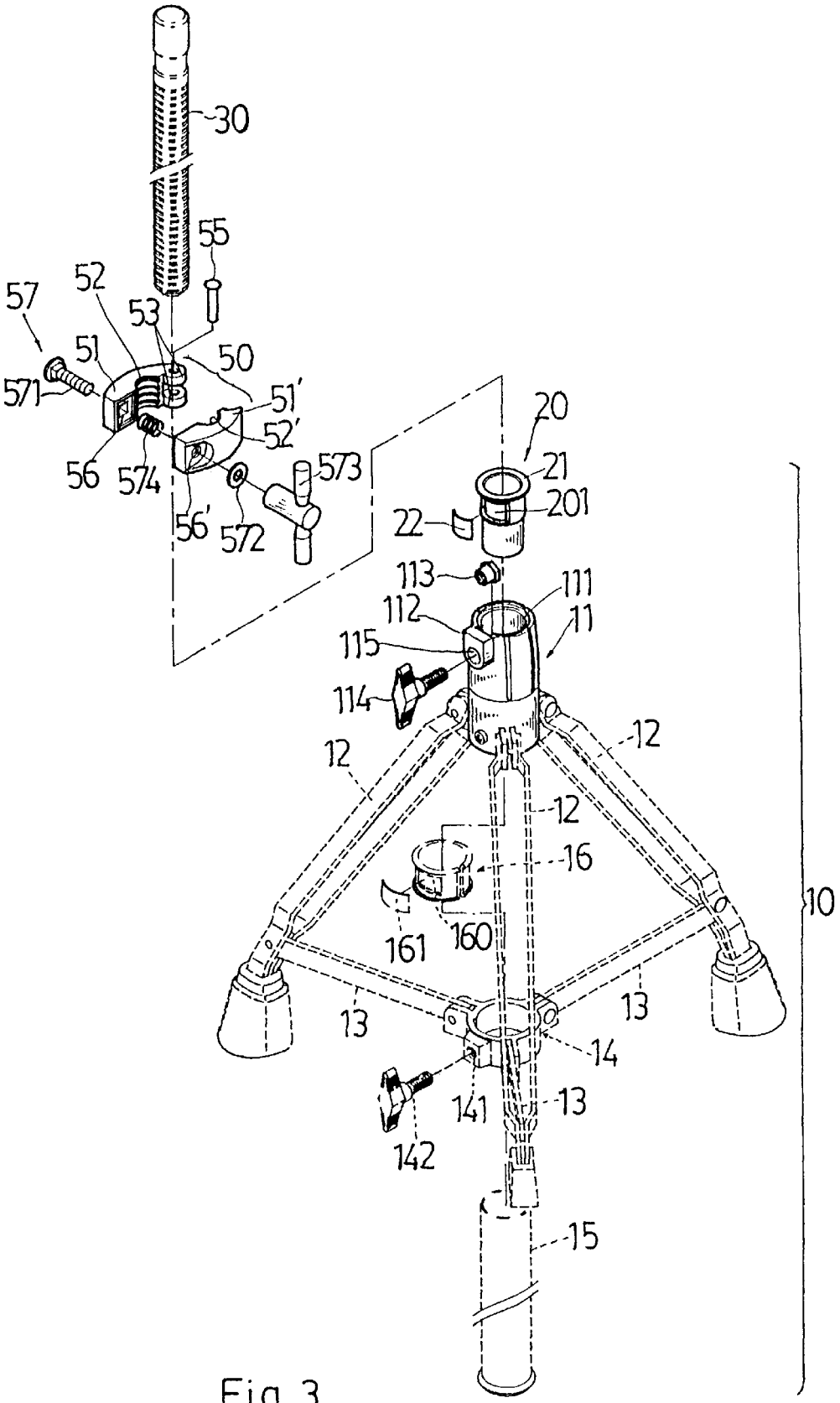
FIG. 3 is an exploded view of an adjustable chair stand according to the present invention.
Figure 7:
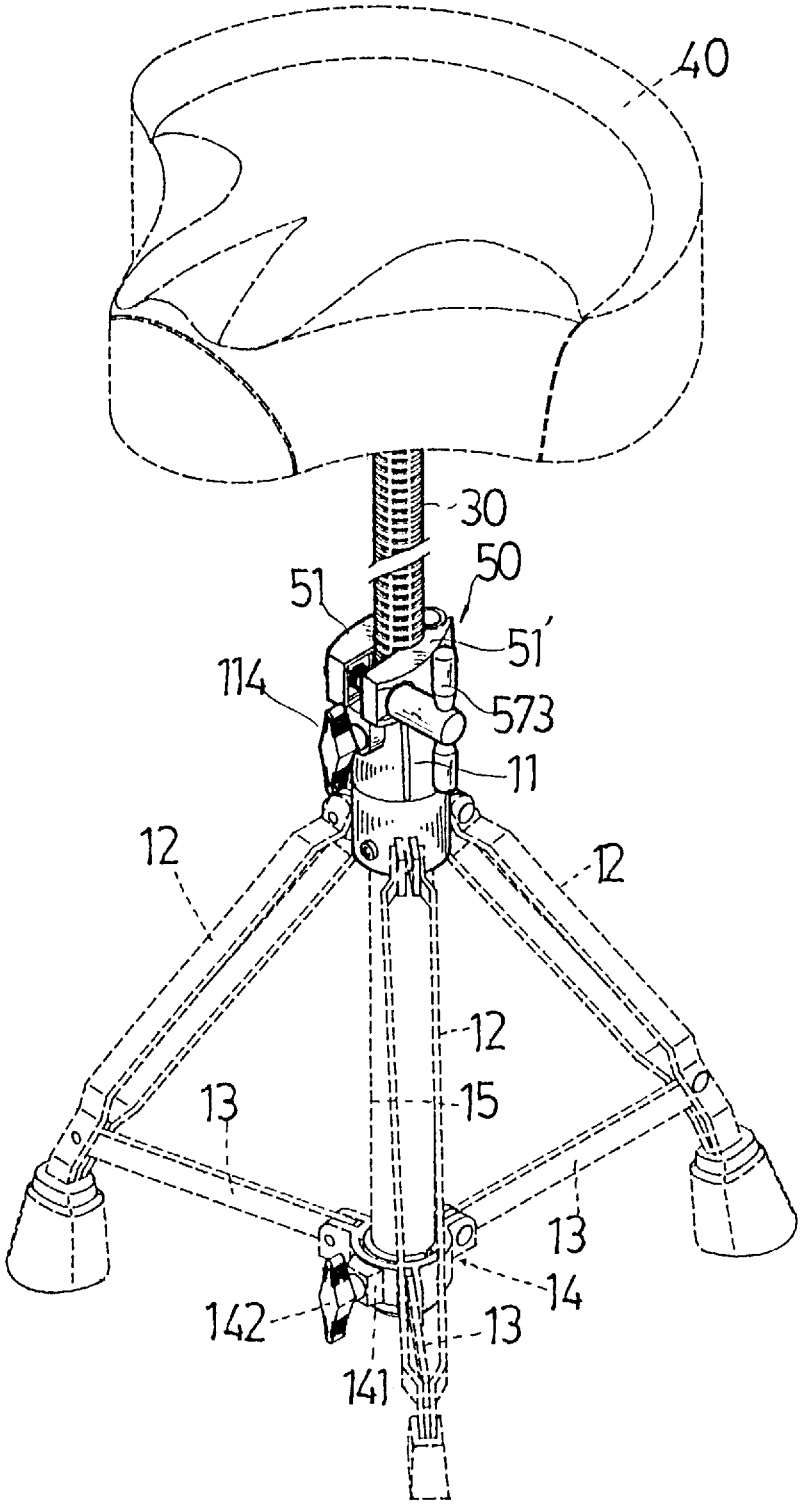
FIG. 7 is an assembly view of the present invention.

Referring to FIGS. 3 and 7, the stand, referenced by 10, comprises a socket 11, a plurality of legs 12 pivoted to the socket 11 and adapted for supporting on the floor, a locating ring 14, a plurality of links 13 respectively coupled between the locating ring 14 and the legs 12, and a sleeve 15 connected between the locating ring 14 and the socket 11.

Referring to FIGS. 3, 4, 5A and 7, the socket 11 comprises an annular groove 111 at the top, a block 112 at one side, a transverse through hole 115 pierced through the block 112, a nut 113 mounted in the through hole 115, and a lock screw 114 threaded into the nut 113 in the through hole 115 and projecting into the inside of the socket 11. A plastic packing ring 16 is mounted within the locating ring 14 around the sleeve 15. The packing ring 16 has a side opening 160. A smoothly curved packing plate 161 is inserted into the side opening 160 of the packing ring 16. A lock screw 142 is threaded into a screw hole 141 on the locating ring 14, and pressed on the packing plate 161 against the periphery of the sleeve 15 to fix the sleeve 15 to the locating ring 14.

Figure 4:
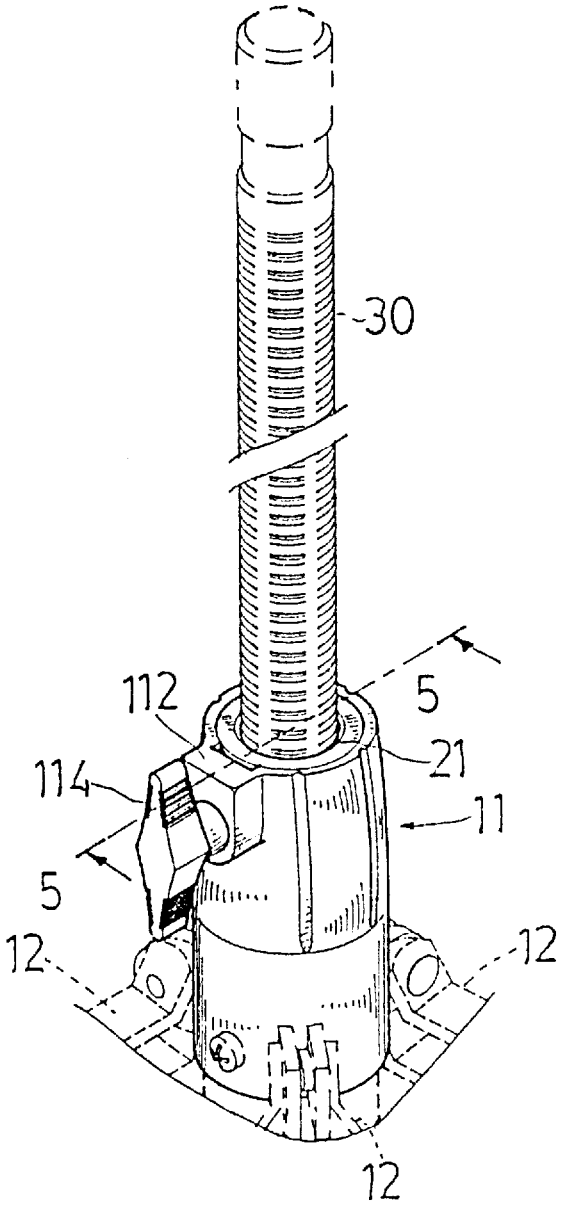
FIG. 4 is a perspective view in an enlarged scale of a part of the present invention, showing the threaded stem fixed to the socket.
Figure 5:
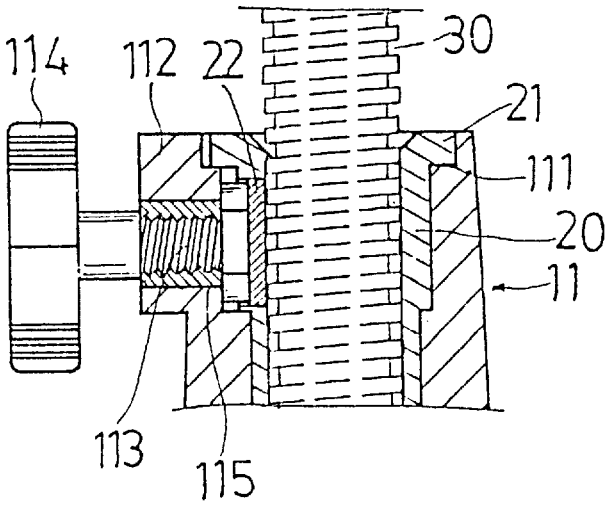
FIG. 5 is sectional view taken along line 5—5 of FIG. 4.

Referring to FIGS. 3, 4 and 5A, a metal bushing 20 is mounted in the socket 11. The metal bushing 20 comprises a top flange 21 fit into engagement with the annular groove 111 of the socket 11 and disposed in flush with its topmost edge, a side opening 201, and a smoothly curved packing plate 22 inserted into the side opening 201.

Referring to FIG. 5A and 7, a threaded stem 30 is provided having a bottom end inserted through the bushing 20 into the sleeve 15, and a top end connected to a seat 40. When the threaded stem 30 is inserted through the bushing 20 into the sleeve 15, the lock screw 114 is fastened tight to impart a pressure to the packing plate 22 against the periphery of the threaded stem 30, thereby causing the threaded stem 30 to be fixed in place.

Figure 6:
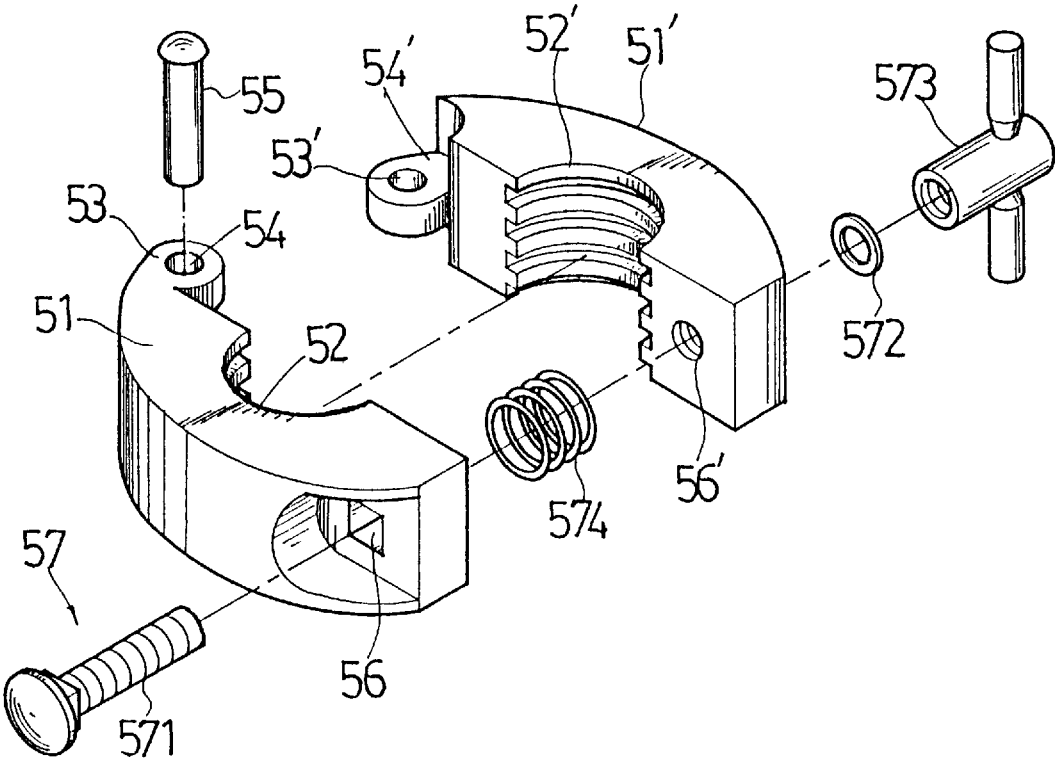
FIG. 6 is an exploded view of the clamping device according to the present invention.

Referring to FIGS. 3, 6 and 7, a clamping device 50 is fastened to the threaded stem 30 and supported on the socket 11 of the stand 10 to stop the threaded stem 30 from linear movement. The clamping device 50 comprises two symmetrical arched clamping plates, namely, the first arched clamping plate 51 and the second arched clamping plate 51'. The first arched clamping plate 51 comprises two lugs 53 vertically spaced at one end and defining a respective pivot hole 54, a horizontal through hole 56 at an opposite end, and a plurality of vertically spaced grooves 52 at an inner side between the lugs 53 and the horizontal through hole 56 for engagement with the threads of the threaded stem 30. The second arched clamping plate 51' comprises a lug 53' disposed at one end on the middle and defining a pivot hole 54', a horizontal through hole at an opposite end, and a plurality of vertically spaced grooves 52' at an inner side between the lug 53' and the horizontal through hole 56 for engagement with the threads of the threaded stem 30. The first arched clamping plate 51 and the second arched clamping plate 51' are pivoted together by fastening a pivot 55 to the pivot holes 54 of the lugs 53 of the first arched clamping plate 51 and the pivot hole 54' of the lug 53' of the second arched clamping plate 51', permitting the lug 53' of the second arched clamping plate 51' to be retained between the lugs 53 of the first arched clamping plate 51. When the first arched clamping plate 51 and the arched clamping plate 51' are pivoted together, they are fastened to the threaded stem 30 by a fastener 57 and supported on the socket 11 of the stand 10. The fastener 57 comprises a screw bolt 571 inserted through the horizontal through hole 56 of the first arched clamping plate 51 and the horizontal through hole 56' of the second arched clamping plate 51', a compression spring 574 mounted around the screw bolt 57 and retained between the arched clamping plates 51;51', a hand bar end nut 573 threaded onto the screw bolt 57 to fix the arched clamping plates 51;51' together, and a washer 572 mounted around the screw bolt 57 and retained between the hand bar end nut 573 and the second arched clamping plate 51'.

When the clamping device 50 and the arched clamping plate 22 of the bushing 20 are loosened, the threaded stem 30 can then be adjusted up and down. Because the bushing 20 has a smooth inside wall, the threaded stem 30 can be directly moved up and down in the socket 11 without through a rotary motion. After the threaded stem 30 has been adjusted to the desired elevation, the lock screw 114 is fastened up to press the arched packing plate 22 against the periphery of the threaded stem 30, and the handle bar end nut 573 is screwed up with the screw bolt 57 to fix the arched clamping plates 51;51' together and to force the grooves 52;52' of the arched clamping plates 51;51' into engagement with the threads of the threaded stem 30.

What the invention claimed is:

1. An adjustable chair stand comprising:

a stand, said stand comprising a socket at a top side thereof, said socket having a top annular groove and a nut embedded in a transverse through hole thereof;

a threaded stem inserted into said socket of said stand and secured thereto to support a seat at the desired elevation;

a bushing mounted in said socket around said threaded stem, said bushing comprising a top flange supported on said top annular groove of said socket, a side opening, and an arched packing plate inserted in said side opening;

a lock screw threaded into said nut and pressed on said arched packing plate against said threaded stem; and a clamping device fastened to said threaded stem and supported on said socket of said stand to stop said threaded stem from linear movement, said clamping device comprising two arched clamping plates hinged together, said arched clamping plates having a respective fixed end hinged together, a plurality of vertically spaced grooves at an inner side respectively forced into engagement with said threaded stem, and a respective free end made with a respective transverse through hole, and a fastener adapted to fix the free ends of said arched clamping plates together.

* * * * *